US009695646B2

(12) United States Patent
Grice

(10) Patent No.: US 9,695,646 B2
(45) Date of Patent: Jul. 4, 2017

(54) WIRELINE CONNECTOR INCLUDING AN ELECTROMAGNET AND A METAL

(71) Applicant: Halliburton Energy Services, Inc., Houston, TX (US)

(72) Inventor: William B Grice, Carrollton, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 0 days.

(21) Appl. No.: 14/768,441

(22) PCT Filed: Mar. 1, 2013

(86) PCT No.: PCT/US2013/028570
§ 371 (c)(1),
(2) Date: Aug. 17, 2015

(87) PCT Pub. No.: WO2014/133540
PCT Pub. Date: Sep. 4, 2014

(65) Prior Publication Data

US 2016/0002984 A1 Jan. 7, 2016

(51) Int. Cl.
*E21B 17/02* (2006.01)
*H01R 13/62* (2006.01)
(Continued)

(52) U.S. Cl.
CPC ..... *E21B 17/028* (2013.01); *E21B 17/023* (2013.01); *E21B 17/04* (2013.01);
(Continued)

(58) Field of Classification Search
CPC ..... E21B 17/023; E21B 17/028; E21B 17/04; E21B 19/16; E21B 47/122; H01F 7/20; H01R 13/6205
See application file for complete search history.

(56) References Cited

U.S. PATENT DOCUMENTS 7,064,676 B2 * 6/2006 Hall ..... E21B 17/028 166/242.6
7,311,526 B2 * 12/2007 Rohrbach ..... H01R 13/6205 439/218

(Continued)

FOREIGN PATENT DOCUMENTS

WO WO-2012-113757 A1 8/2012
WO WO-2012-117034 A1 9/2012

OTHER PUBLICATIONS

International Search.
International Search Report and Written Opinion date mailed Nov. 15, 2013; PCT Application No. PCT/US2013/028570.

*Primary Examiner* — Matthew R Buck
(74) *Attorney, Agent, or Firm* — McGuireWoods

(57) ABSTRACT

A wireline coupler that connects a first data wireline to a second data wireline comprises: a first housing that is attached to the first data wireline, wherein the first housing comprises an electromagnet; a second housing that is attached to the second data wireline, wherein the second housing comprises a metal; wherein the electromagnet forms a magnetic field when electrical data flows in the first wireline, and wherein the magnetic field attracts the metal of the second housing and causes the first housing to connect with the second housing, such that first data wireline is operationally connected with the second data wireline.

18 Claims, 4 Drawing Sheets

(51) Int. Cl.

| | |
|---|---|
| ***E21B 17/04*** | (2006.01) |
| ***E21B 19/16*** | (2006.01) |
| ***E21B 47/12*** | (2012.01) |
| ***H01F 7/20*** | (2006.01) |

(52) U.S. Cl.
CPC ..... *E21B 19/16* (2013.01); *E21B 47/122* (2013.01); *H01F 7/20* (2013.01); *H01R 13/6205* (2013.01)

(56) References Cited

U.S. PATENT DOCUMENTS

| | | | | |
|---|---|---|---|---|
| 8,348,678 | B2 * | 1/2013 | Hardisty | H01R 13/6205 439/39 |
| 8,388,353 | B2 * | 3/2013 | Kiani | H01R 11/30 439/39 |
| 9,306,322 | B2 * | 4/2016 | Bhimavarapu | H01R 13/6205 |
| 9,322,224 | B2 * | 4/2016 | Chabas | E21B 17/028 |
| 2002/0193004 | A1 * | 12/2002 | Boyle | E21B 17/028 439/577 |
| 2009/0102590 | A1 * | 4/2009 | Rhodes | H01F 38/14 336/107 |

* cited by examiner

WIRELINE CONNECTOR INCLUDING AN ELECTROMAGNET AND A METAL

TECHNICAL FIELD

A wireline is a line of wire that is used to communicate with a subsurface device that is located downhole in a wellbore. The wireline is typically comprised of pieces of wire that are connected to each other. The wireline is connected to a surface device and the subsurface device.

SUMMARY

According to an embodiment, a wireline coupler that connects a first data wireline to a second data wireline comprising: a first housing that is attached to the first data wireline, wherein the first housing comprises an electromagnet; a second housing that is attached to the second data wireline, wherein the second housing comprises a metal; wherein the electromagnet forms a magnetic field when electrical data flows in the first wireline, and wherein the magnetic field attracts the metal of the second housing and causes the first housing to connect with the second housing, such that first data wireline is operationally connected with the second data wireline.

According to another embodiment, a well system comprising: a first pipe section having a first wireline that is associated with the first pipe section, wherein the first wireline has a male housing located at one end of the first wireline and a female housing located at the other end of the first wireline, wherein the male housing comprises a first electromagnet and the female housing comprises a first metal; and a second pipe section having a second wireline that is associated with the second pipe section, wherein the second wireline has a male housing located at one end of the second wireline and a female housing located at the other end of the second wireline, wherein the male housing comprises a second electromagnet and the female housing comprises a second metal; wherein the male housing of the first wireline is placed proximate to the female housing of the second wireline, whereby when the first wireline is energized, the male housing of the first wireline is attracted to the female housing of the second wireline, and the first wireline is operationally connected to the second wireline, and whereby when the first wireline is de-energized, the male housing of the first wireline loses attraction to the female housing of the second wireline, and the first wireline is operationally disconnected to the second wireline.

According to a further embodiment, a method of connecting a first pipe section to a second pipe section of a tubing string in a well system comprising: providing a source of power to a first magnet, wherein the first magnet is part of a male housing of a first wireline, wherein the first wireline is associated with the first pipe section; positioning the first wireline adjacent to a second wireline, wherein the second wireline is associated with the second pipe section, wherein the second wireline comprises a female housing, and wherein the female housing comprises a metal; connecting the first pipe section to the second pipe section such that the male housing of the first wireline is located proximate to the female housing of the second wireline, wherein the step of providing forms a magnetic field such that the male housing attracts the female housing to the male housing; and allowing the first wireline and the second wireline to create an electrical connection with one another.

According to a further embodiment, a method of quickly disconnecting a first wireline from a second wireline in a well system comprising: removing a source of power to a first magnet, wherein the first magnet is part of a male housing of a first wireline, wherein the first wireline is permanently or removably attached to a first pipe section of a tubing string, wherein the step of removing causes an existing magnetic field between the first magnet of the first wireline and a metal of a female housing to cease, wherein the female housing is part of a second wireline, and wherein the second wireline is permanently or removably attached to a second pipe section of the tubing string; and allowing or causing the first wireline to become physically disconnected from the second wireline.

BRIEF DESCRIPTION OF THE FIGURES

The features and advantages of certain embodiments will be more readily appreciated when considered in conjunction with the accompanying figures. The figures are not to be construed as limiting any of the preferred embodiments.

DETAILED DESCRIPTION

Figure 1A:
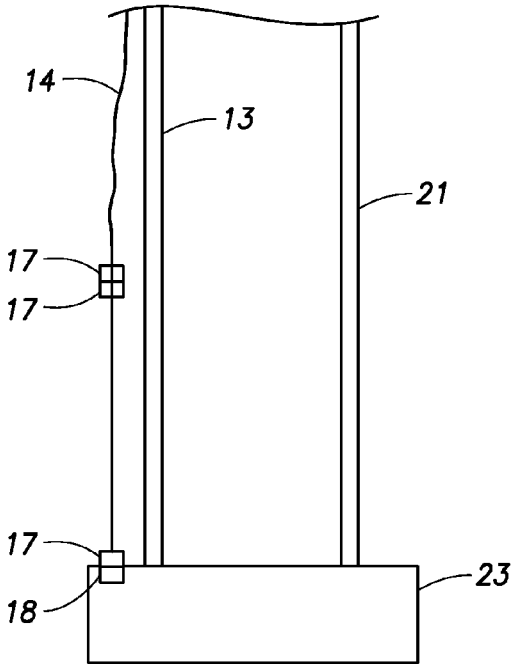
FIGS. 1A and 1B depict two arrangements for a wireline, namely one outside the tubing string and one inside the tubing string.

As used herein, the words "comprise," "have," "include," and all grammatical variations thereof are each intended to have an open, non-limiting meaning that does not exclude additional elements or steps.

It should be understood that, as used herein, "first," "second," "third," etc., are arbitrarily assigned and are merely intended to differentiate between two or more wirelines, pipe sections, etc., as the case may be, and does not indicate any sequence. Furthermore, it is to be understood that the mere use of the term "first" does not require that there be any "second," and the mere use of the term "second" does not require that there be any "third," etc.

As used herein, the relative term "down", and all grammatical variations thereof, means in a direction away from the wellhead. Conversely, the relative term "up", and all grammatical variations thereof, means in a direction towards the wellhead. Moreover, the term "below" means at a location farther away from the wellhead compared to another location; and the term "above" means at a location closer to the wellhead compared to another location. By way of example, reference to a housing being below another component or device means that the housing is at a location farther away from the wellhead compared to the other component or device.

Oil and gas hydrocarbons are naturally occurring in some subterranean formations. A subterranean formation containing oil or gas is sometimes referred to as a reservoir. A reservoir may be located under land or off shore. In order to produce oil or gas, a wellbore is drilled into a reservoir or adjacent to a reservoir.

A well can include, without limitation, an oil, gas, or water production well, or an injection well. As used herein, a "well" includes at least one wellbore. A wellbore can include vertical, inclined, and horizontal portions, and it can be straight, curved, or branched. As used herein, the term "wellbore" includes any cased, and any uncased, open-hole portion of the wellbore. As used herein, "into a well" means and includes into any portion of a wellbore.

A drill bit can be used to form a primary wellbore. A tubing string, commonly called a drill string, can be used to aid the drill bit in drilling through the subterranean formation to form the wellbore. The drill string can include a drilling pipe. During drilling operations, a drilling fluid, sometimes referred to as a drilling mud, may be circulated downwardly through the drilling pipe, and back up the annulus between the wall of the wellbore and the outside of the drilling pipe. The drilling fluid performs various functions, such as cooling the drill bit, maintaining the desired pressure in the well, and carrying drill cuttings upwardly through the wellbore annulus.

After the primary wellbore is drilled, a tubing string, called casing, can be placed into the wellbore. The casing can be cemented in the wellbore by introducing a cement composition in the annulus between the wall of the wellbore and the outside of the casing. The cement can help stabilize and secure the casing in the wellbore.

After a wellbore has been drilled, the wellbore is then completed. During completion of an open-hole wellbore, a tubing string may be placed into the wellbore. The tubing string allows fluids to be introduced into or flowed from a remote portion of the wellbore. A tubing is a section of tubular pipe, usually 30 feet in length. Examples of a pipe can include, but are not limited to, a casing, a blank pipe, a sand screen, or a wash pipe. A tubing string refers to multiple sections of pipe connected to each other. A tubing string is created by joining multiple sections of pipe together. This is generally accomplished by picking up a first section of pipe with an elevator. If the section of pipe includes a ring, then the section of pipe can be lowered to a release table. The release table can include a ram that is capable of opening and closing. The ram can be opened or closed via hydraulic pistons. In the closed position, the inner diameter (I.D.) of the ram is less than the outer diameter (O.D.) of the ring of the pipe. In this manner, a section of pipe fitted with a ring can be lowered on top of the closed ram such that the ring rests on top of the ram and the section of pipe is suspended from the release table. The elevator can be released and the pipe is prevented from falling into the wellbore via the ram and ring. A second section of pipe, also fitted with a ring, can now be joined to the first section. This is accomplished be picking up the second section with the elevator. The second section is lowered to an area above the top of the first section. The two sections of pipe are connected to each other via threaded joints. After connection, the ram is opened, the two sections are lowered such that the ring of the first section is located below the ram and the ring of the second section is located slightly above the ram. The ram is closed and the two sections are lowered until the ring of the second section rests on top of the closed ram. This process is repeated until the desired length of tubing string is achieved.

A wireline is often used during oil and gas operations. In the oil and gas industry, the term wireline usually refers to a cabling technology used by operators of oil and gas wells to lower equipment or measurement devices into the well for the purposes of well intervention, reservoir evaluation, and pipe recovery. The wireline is used to transmit data about the well to the surface where operators can obtain the necessary information about the well. The wireline can also carry data and/or power down to the tool or tools in the well.

A wireline can comprise a single strand or multi-strands. Braided line can contain an inner core of insulated wires which provide power to equipment located at the end of the cable, normally referred to as electric line, and provides a pathway for electrical telemetry for communication between the surface and subsurface devices or tools located at the end of the cable. Examples of subsurface devices or tools can include a drill bit, a perforating gun, a core sampler, ARMADA® Slickline Sampler, ARMADA® Sampling System, sensors, or other devices. Accordingly, the wireline can be used to send telemetry from a sensor on the device to a data receiver located at the surface, for example data regarding temperature, revolutions per minute (rpm), orientation, angle, depth, flow rate, pressure, pounds force per square inch (psi), telemetry, particulate amounts or other measurements.

The wireline can also be used to carry control signals from the data receiver located at the surface to the device. Also, the wireline can be used to carry power down to the device from the surface, which can eliminate the need for a battery-powered device. Often times, the wireline is run into the well along with the tubing string. For example, as each section of pipe is connected to one other and run into the well, the wireline can be attached to the inside or outside of each section of pipe and run into the well. A wireline can also be introduced into a well after the tubing string has been run into the well. As used herein, the present sense of the term "run," and all grammatical variations thereof, means the process of connecting sections of pipe together to form a tubing string. As used herein, the past sense of the term "run," and all grammatical variations thereof, means a tubing string that has already been placed in the wellbore. In some instances, the wireline can be located inside of a tubing string, for example a casing. For example, if the device is located within the tubing string or within a section of pipe, then the wireline would also be located within the tubing string. In other instances, the wireline may be attached to the tubing string on the outside of the tubing string. One way to attach the wireline to the tubing string is to use collar connectors. Traditionally, wireline segments are connected to each other via threaded connections. Threaded connections are also used to connect the wireline to the subsurface tool. The wireline is clamped to the exterior of the pipe using collar connectors or other types of connectors.

A wireline, however, can be difficult to remove from a well once it has been placed in the wellbore. It is also difficult to release a wireline from the device or tool that is connected to the end of the wireline. Generally, in order to remove the wireline and/or the tool or device attached to the end of the wireline, the entire length of wireline must be removed from the well or the wireline must be cut. Moreover, when the wireline is connected to a tubing string, then the entire section of tubing string connected to the wireline must also be removed from the well. This process is not only very time consuming, but also costly to operations. For example, the threaded connections of wirelines do not allow the wireline to be easily disconnected. For example, on a sea platform, it is preferable to disconnect the wireline for an approaching storm. The rough seas may damage the wireline. The threaded connections prevent the wireline sections from being disconnected from each other. The only way to disconnect the wireline is to pull the entire length of pipe from the wellbore and possibly from the water. To leave the wireline in place during a storm invites damage to the wireline and to the tool itself. The wireline may pull on the tool and damage the tool. Furthermore, the threaded connections can become corroded together and thus more difficult to separate. In other words, the wireline does not easily release from the tool and may induce a force on the tool and break the tool.

Thus, there is a need for a way to quickly connect and disconnect wireline sections. It has been discovered that a male housing containing an electromagnet on a first wireline can be used to quickly connect with a female housing containing a metal located on a second wireline. The electromagnet can also be de-energized in order to quickly disconnect the first and second wirelines. The embodiments of the wireline connector described herein can be used to quickly attach multiple wirelines together via the electromagnet or used to connect multiple wirelines to a tool. The wireline connector can also be used to quickly disconnect multiple wirelines by stopping a current to the electromagnet.

According to an embodiment, a wireline coupler that connects a first data wireline to a second data wireline comprises: a first housing that is attached to the first data wireline, wherein the first housing comprises an electromagnet; a second housing that is attached to the second data wireline, wherein the second housing comprises a metal; wherein the electromagnet forms a magnetic field when electrical data flows in the first wireline, and wherein the magnetic field attracts the metal of the second housing and causes the first housing to connect with the second housing, such that first data wireline is operationally connected with the second data wireline.

According to another embodiment, a well system comprises: a first pipe section having a first wireline that is associated with the first pipe section, wherein the first wireline has a male housing located at one end of the first wireline and a female housing located at the other end of the first wireline, wherein the male housing has a first electromagnet and the female housing comprises a first metal; and a second pipe section having a second wireline that is associated with the second pipe section, wherein the second wireline has a male housing located at one end of the second wireline and a female housing located at the other end of the second wireline, wherein the male housing has a second electromagnet and the female housing comprises a second metal; wherein the male housing of the first pipe section is placed proximate to the female housing of the second pipe section, whereby when the first wireline is energized, the male housing of the first wireline is attracted to the female housing of the second wireline, and the first wireline is operationally connected to the second wireline, and whereby when the first wireline is de-energized, the male housing of the first wireline loses attraction to the female housing of the second wireline, and the first wireline is operationally disconnected to the second wireline.

Any discussion of the embodiments regarding the wireline coupler or any component thereof is intended to apply to all of the apparatus and method embodiments. Any discussion of a particular component of an embodiment (e.g., the wireline or first housing) is meant to include the singular form of the component and also the plural form of the component, without the need to continually refer to the component in the singular and plural form throughout. For example, if the discussion involves "the wireline," it is to be understood that the discussion pertains to one wireline (singular) and two or more wirelines (plural).

Figure 1B:
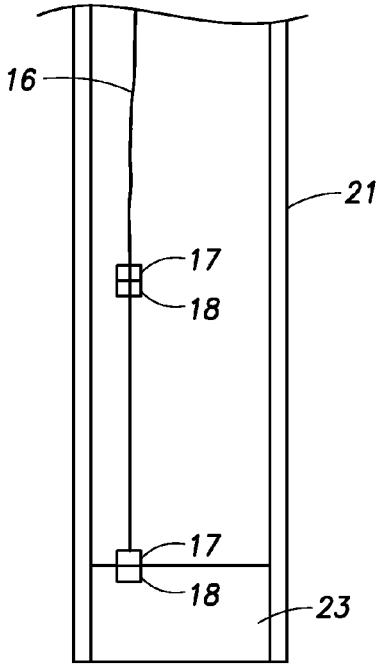
Figure 2A:
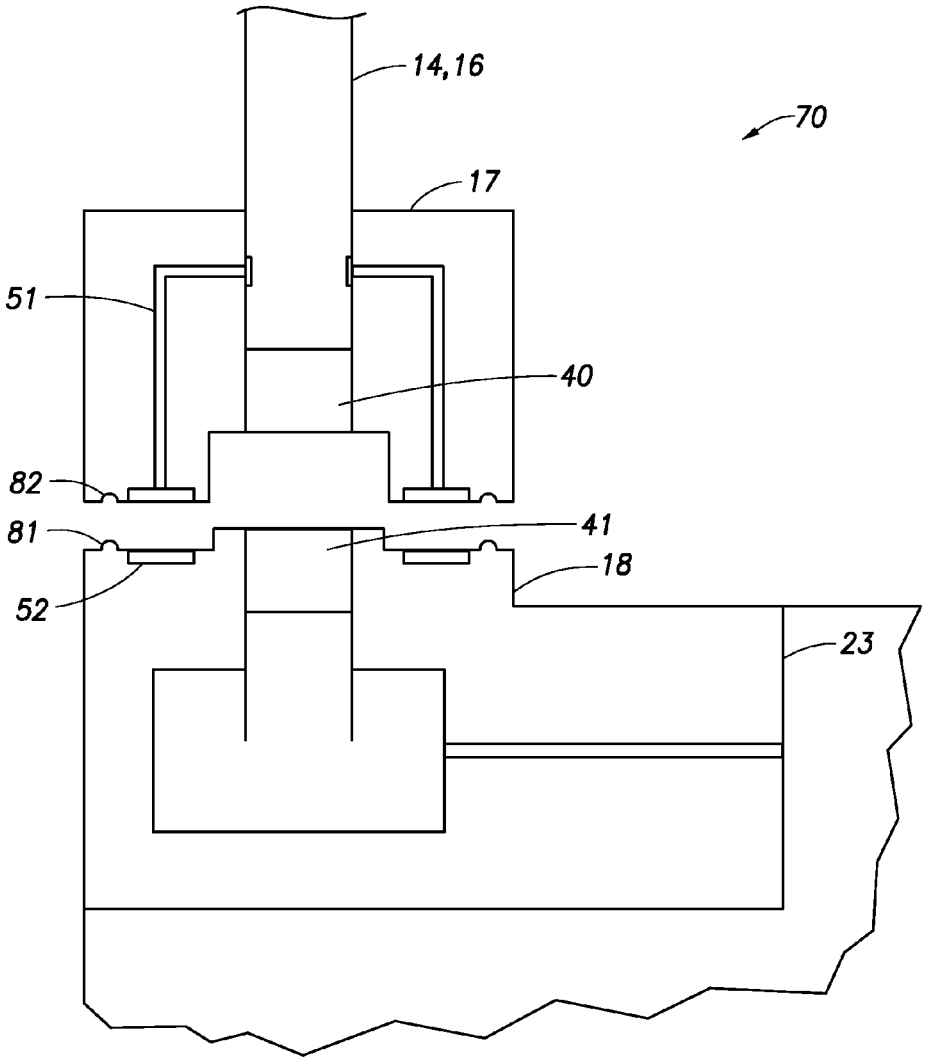
FIGS. 2A and 2B depict two examples of details of the wireline connection to the tool shown in FIGS. 1A and 1B.

Turning to the Figures, FIG. 1A depicts one example of an arrangement of wirelines, while FIG. 1B depicts another arrangement. As used herein, the term "wireline" can refer to a complete wireline or a section of wireline as the context dictates and does not necessarily imply a particular length of the wireline. In some contexts, the wireline can have a specified length that can be used to correspond to a length of a section of pipe. FIG. 2A depicts an example of a wireline coupler 70 that is used to form the quick connection. The wireline coupler comprises at least a first wireline and a second wireline. The wireline coupler can also include more than two wirelines, for example, a third wireline, a fourth wireline, and so on. According to an embodiment, the wirelines are a data wireline. The wireline can be capable of handling different signals (e.g., power, command, data, etc.) The wireline can comprise a co-axial cable, a twisted two wire pair, an Ethernet wire, one or more copper wires, and/or combinations thereof. The first wireline can be the same or different from the second wireline. By way of example, the first wireline can be a co-axial cable and the second wireline can be a twisted two pair wire. However, the specific type of each wireline selected should be chosen such that each wireline is capable of communicating the desired information, for example, data, between each wirelines. The wireline may include an optical fiber, but a metal wire is needed to energize the electrometric used in the quick connection.

The wireline can carry a data signal, wherein the data signal comprises one or more of a carrier wave and data, a radio frequency (RF) signal, and/or power. The first and second wirelines can be operative to perform at least one of the following: controlling a tool, relaying information about the tool, relaying information about an environment adjacent to the tool, relaying sensor information, and/or relaying information or other data from various user applications. The information relayed can include, without limitation, telemetry, revolutions per minute, temperature, orientation, depth, angle, pressure (e.g., pounds force per square inch "psi"), flow rate, the concentration of particulate (e.g., parts per million "ppm"), other information, or combinations thereof.

The first wireline comprises a first housing 17. The first housing 17 can be located at one end of the first wireline. The first housing 17 can be a male housing. The first housing 17 comprises an electromagnet 51. The electromagnet 51 can comprise a metal. The metal of the electromagnet 51 can be selected from the group consisting of iron, nickel, cobalt, rare earth elements, and combinations thereof. It is to be understood that as used herein, the term "metal" is meant to include pure metals and metal alloys without the need to continually specify that the metal can also be a metal alloy. Moreover, the use of the phrase "metal or metal alloy" in one sentence or paragraph does not mean that the mere use of the word "metal" in another sentence or paragraph is meant to exclude a metal alloy. As used herein, the term "metal alloy" means a mixture of two or more elements, wherein at least one of the elements is a metal. The other element(s) can be a non-metal or a different metal. An example of a metal and non-metal alloy is steel, comprising the metal element iron and the non-metal element carbon. An example of a metal and metal alloy is bronze, comprising the metallic elements copper and tin. The electromagnet can be a temporary magnet.

The second wireline comprises a second housing 18. The second housing 18 can be a female housing. The second housing 18 can be located at one end of the second wireline. The second housing comprises a metal 52. The metal 52 can be any metal that is attracted to the electromagnet 51 of the first housing 17. The metal 52 can be selected from the group consisting of iron, nickel, other magnetic materials, and combinations thereof.

According to an embodiment, the electromagnet 51 forms a magnetic field when electrical data flows in the first wireline. The magnetic field can also be formed when a source of energy flows in the first wireline. The source of energy can be, without limitation, an electrical current or RF energy carrier wave. In general, a magnetic field attracts magnetic materials, e.g. ferrous metals, and in this case, the magnetic field 51 causes an attraction with the metal 52 of the female connector 18. The wireline coupler 70 can be used to connect the first and second wirelines together. For example, the magnetic field attracts the metal 52 of the second housing 18 and causes the first housing 17 to connect with the second housing 18, such that the first wireline is operationally connected with the second wireline.

According to another embodiment, and as depicted in FIGS. 1A-2A, the first wireline can be used to connect to a wellbore tool 23. For example, the coupler 70 can connect, electrically or operationally, the end 40 of the first wireline 14, 16 to the end 41 of the tool 23. The end 41 of the tool 23 contains the metal 52. The tool 23 can be a drill bit, a perforating gun, a core sampler, a sampling system, a slickline sampling system, a sensor, a packer, or combinations thereof. When the first wireline 14, 16 is energized with a signal, the signal causes the electromagnet 51 to form a magnetic field. The attraction causes an end that is moveable with respect to the other end to move to the other end. In this case, the end 40 is moveable, while the end 41 is fixed to the tool 23. Thus, the attraction causes the end 40 to move to the end 41. If both ends are moveable, for example, if end 40 and end 41 are ends of two sections of wireline, then both ends would move toward each other. The attraction also maintains a connection between end 40 and end 41.

Thus, one way to couple the first housing 17 and the second housing 18 is to first make a physical connection between the ends 40 and 41, and then energize the first wireline 14, 16. The generated magnetic field would maintain the connection. Another way to couple the first housing 17 and the second housing 18 is to place the first housing 17 proximate with the second housing 18 (or vice versa), and then energize the first wireline. The wireline coupler can also comprise a controller 60 that is operatively connected to the first wireline. The controller 60 can be used to direct the tool 23 and/or receive or transmit information to or from the tool. The magnetic field generated by the electromagnet 51 of the first housing 17 will cause one of or both of the first housing 17 and second housing 18 to move toward each other, and then connect end 40 with end 41. With a connection formed between ends 40 and 41, a signal may flow between the first wireline 14, 16 and the tool 23. The signal can be used as described above, e.g. to carry data, control signals, power, etc.

As used herein, the term "proximate" means fixedly located close enough to each other so that when power is applied to the first wireline, the first housing 17 will attract the second housing 18, and cause the first housing 17 to connect to the second housing 18, such that the two housings are operationally connected with each other. The stronger the attractive force formed from the interaction of the magnetic field and the metal, the greater the distance between the connectors can be and still be proximate. Note that the attractive force can be increased by increasing the magnetic field by either increasing the amount of energy in the first wireline or by increasing the magnet attractive behavior of the electromagnet or the metal. By way of example, a nickel iron alloy has a greater attractive force compared to a nickel cadmium alloy.

Figure 2B:
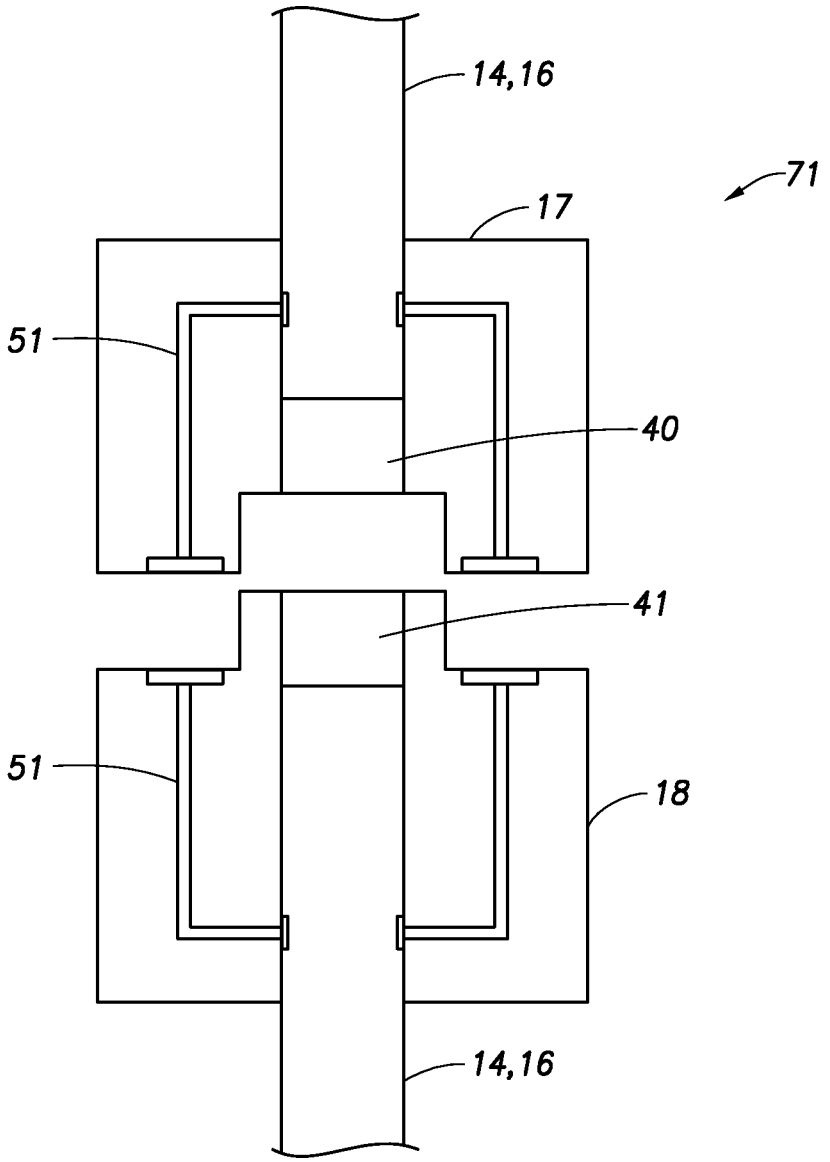

FIG. 2B depicts another example of a coupler 71 that is used to form the quick connection, which is similar to the coupler 70 of FIG. 2A. In this embodiment, the coupler 71 comprises the first housing 17 and second housing 18 that each has an electromagnet 51. As depicted in FIG. 2A, the first housing 17 is located upstream of the second housing 18. According to an embodiment, the upstream portion of the first housing 17 would have to be energized to form the magnetic field. However, either the upstream portion or the downstream portion may be energized to form the magnetic field depending on the source of the energy. Thus, the connection between the first and second housings can be made by energizing the downstream portion before the upstream portion or vice versa. In order for the electromagnets to attract one another, the magnetic field formed by the electromagnet in the first housing 17 should be opposite in polarity to the magnetic field formed by the electromagnet in the second housing 18. This coupler 71 would operate similarly to the coupler 70 in order to connect two or more wirelines or connect the first wireline with a tool.

The wireline coupler can also include a third wireline and so on. Any of the wirelines can also comprise two housings, wherein the two housings can be located at opposite ends of the wireline and wherein the two housings can be the same or different. For example, a first housing can be a male housing located at one end of the first wireline and the second housing can be a female housing located at the opposite end of the first wireline. The housings located at each end of the wireline can be used to connect with a corresponding housing located on a tool or another wireline.

The source of energy that creates the magnetic field of the electromagnet 51 can come from upstream or downstream of the first housing 17. By way of example, the source of power can come from the tool 23, wherein the tool is located downstream of the first housing. In this embodiment, the tool 23 can include a battery. The first wireline can be positioned adjacent to the tool, such that the power from the battery creates a magnetic field in the first housing 17 located at the end of the tool. The magnetic field can then attract the metal 52 of a second housing 18 located on one end of the first wireline, such that a connection between the first housing 17 of the tool and the second housing 18 of the first wireline are connected. The energy can now flow upstream in the first wireline and create a magnetic field located in a first housing 17 at the other end of the first wireline. This magnetic field can then attract the metal 52 of a second housing 18 located at an end of a second wireline. A connection between the first wireline and the second wireline can now be formed. The process can continue in this fashion until the desired number of wirelines have been connected. By way of another example, the first wireline can be energized at the surface of the well. The wirelines can be connected in the same manner as just described except that the energy will flow downstream through each wireline to form each subsequent connection.

Note that in this example, the electromagnet is located above the metal, meaning that the electromagnet is located closer to the wellhead. However, the location of the electromagnet and the metal may be reversed. Similarly, in this example, the male end has the electromagnet and the female end has the metal. Again, these may be reversed with the male end having the metal and the female end having the electromagnet. However, it is to be understood that a variety of arrangements can be made, depending on whether the energy source is being supplies from the wellhead or from the tool. The electromagnet will normally be located closest to the energy source (e.g., closest to the tool when the tool supplies the energy source to create the magnetic field or closest to the wellhead when the energy source comes from the rig). In this manner, after the electromagnet receives the energy source or the energy source is terminated or reduced, then the metal will be attracted to, or detached from, the electromagnet for connecting or disconnecting the first wireline from the second wireline or the first wireline from the tool.

According to an embodiment, the wireline coupler further comprises: at least one fitting 81 that is located on the first housing or the second housing; and a receiver 82 that is located on the other of the second housing or the first housing, which is adapted to receive the fitting; wherein the fitting and the receiver act to align the first data wireline and the second data wireline. The fitting and the receiver can cooperate to assist in the alignment of the two connectors. Note that the locations and shapes of the fitting and the receiver are by way of example only as other shapes may be used and the locations of the fitting and the receiver may be different. Alternatively, the fitting and the receiver may be located on the male end and the female end, respectively.

As can be seen, the wireline coupler 70 can be used to quickly and easily connect multiple wirelines with one another and also possibly be used to connect a wireline with a tool. The connection between two or more wirelines can also be severed quickly and efficiently by de-energizing the first wireline. Without energy, the magnetic field formed from the electromagnet 51 will fade and the attraction caused by the field will also fade. This would allow any force that is placed on the wireline or the tool to separate the connection without causing damage to the wireline or the tool.

Moreover, a connection can also be re-established by re-energizing the first wireline. As long as the first housing 17 is proximate to the second housing 18, a re-energized wireline will form a magnetic field that will cause one of or both of the housings to move toward each other, and then connect end 40 with end 41.

As can be seen, the connection of the wirelines via the wireline coupler 70, 71 can be used to relay information about the tool 23 or other downhole conditions of the well. This enables workers to adjust actions at the surface of the well. Moreover, the ease of being able to energize the electromagnet 51 allows workers to quickly connect multiple wirelines together. Additionally, in the event it is necessary to disconnect the wireline from a tool or disconnect one or more wirelines from each other, one can simply de-energize the electromagnet 51 without having the pull the entire wireline and/or tubing string out of the wellbore.

Figure 3:
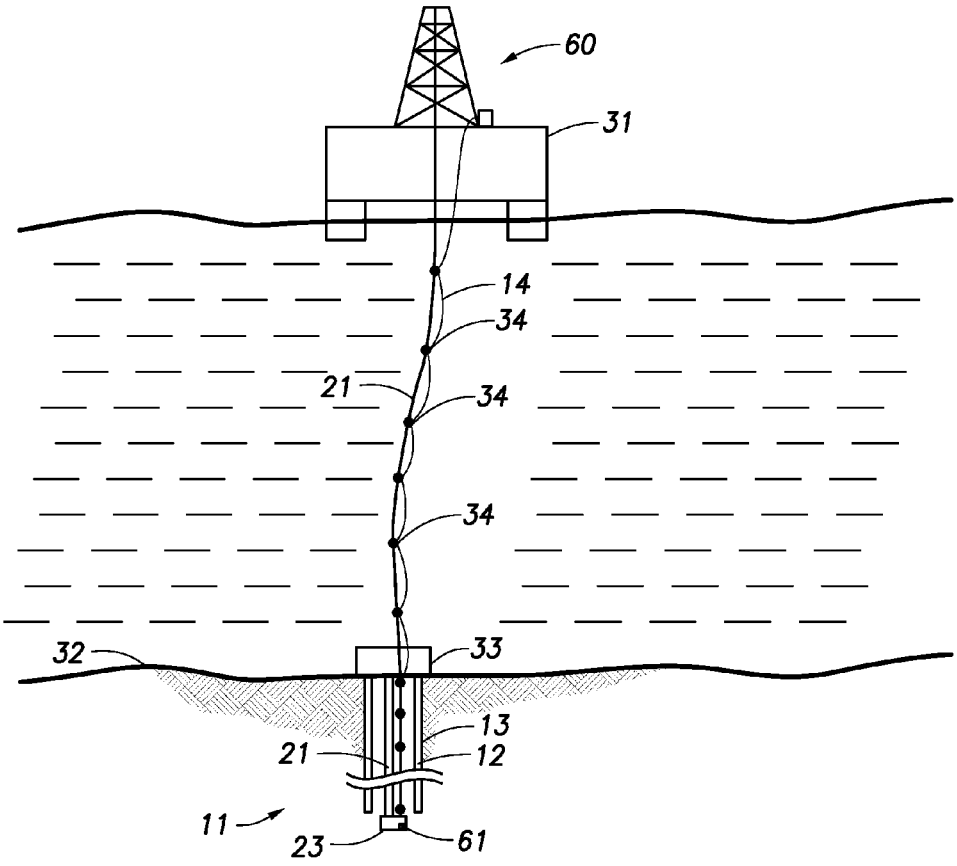
FIG. 3 depicts an example of a connected wireline in a well system.

According to another embodiment, a well system comprises a first pipe section having a first wireline that is associated with the first pipe section and a second pipe section having a second wireline associated with the second pipe section. FIG. 3 depicts an example of connected wireline in a well system. The well system can include a platform 31, a sea floor 32, a blowout preventer 33, and a wellbore 11. In this figure, the tubing string 21, which is comprised of at least the first and second pipe sections, descends from the platform 31 into the wellbore 11, which can penetrate the seafloor 32. The tool 23 can be located at one end of the tubing string. The other end of the tubing string 21 can connect to a device 60 that includes an energy source that is used to energize at least the first wireline. Note that the tool 23 may also have an energy source 61, e.g., a battery that may be used to energize the first wireline in addition to or in place of the device 60 energy source.

The well system 10 can include a wellbore 11 and a wellhead. The wellhead can be located at the sea floor 32. The wellbore 11 can extend down into a subterranean formation. The wellbore 11 can be a primary wellbore or a lateral wellbore. The wellbore 11 can have vertical, horizontal, inclined, straight, or curved sections, and combinations thereof. A section of the wellbore 11 can be a cased-hole wellbore. The cased-hole section can include a casing 13. The casing 13 can be cemented in the wellbore 11 via cement 12.

The wireline 14 comprises at least the first wireline and the second wireline. The wireline 14 can also comprise a plurality of wireline sections. Each wireline section can be connected or disconnected to another wireline section at connection point 34. Each connection point 34 may comprise the first housing 17 and second housing 18 as depicted in FIG. 2A or 2B. FIG. 1A depicts one example of an arrangement of wireline. In this figure, the wireline 14 is located on the outside of a section of pipe of a tubing string 21. FIG. 1B depicts another example of another arrangement of wireline. In this figure, the wireline 14 is located on the inside of the pipe of the tubing string 21.

In some embodiments, it may be convenient to have each wireline (e.g., the first, second, third, and so on wireline) have a similar length to each pipe section in the tubing string. The wireline may be the same length or slightly larger to allow some flexing of the wireline. Thus, as each section of pipe is added to the tubing string, another section of wireline can also be added to the section of pipe. The wireline may be permanently or removably attached to each section of pipe via a variety of mechanisms, for example, by a fastener, such as a clamp, or a clip. According to an embodiment, the wirelines are connected to the sections of pipe such that each end of each wireline is proximate with a corresponding end of an adjacent wireline (for example, such that the first housing 17 of the first wireline will be proximate to the second housing 18 of the second wireline).

However, the wireline may have a different length than the section of pipe. The wireline may be longer than the pipe, so that two or more pipes are needed for each wireline. Also the wireline may be shorter that the pipe, so that two or more wirelines are needed for each pipe section. However, each wireline's length and the corresponding number of wirelines should be selected such that the corresponding first housing 17 and second housing 18 are proximate with each other.

According to an embodiment, a method of connecting a first pipe section from a second pipe section of a tubing string in a well system comprises: providing a source of power to a first electromagnet, wherein the first electromagnet is located within a male housing of a first wireline, wherein the first wireline is associated with the first pipe section; positioning the first wireline adjacent to a second wireline, wherein the second wireline is associated with the second pipe section, wherein the second wireline comprises a female housing, and wherein the female housing comprises a metal; connecting the pipe section to the second pipe section such that the male housing of the first wireline is proximate to the female housing of the second wireline, wherein the step of providing forms a magnetic field such that the male housing attracts the female housing to the male housing; and allowing the first wireline and the second wireline to create an electrical connection with one another.

The tool energy source 61 may be energized as the tubing string is run into the wellbore 11, so that as each wireline is added, each wireline can be connected to one another, and maintains the connection formed by the magnetic field. Alternatively, the tubing string can be run first, then each wireline can be positioned in the wellbore (either inside or outside of the tubing string) such that a connection between each wireline is formed and maintained during the positioning of the wirelines. It is to be understood that the tubing string can be run into the wellbore in any manner known to those skilled in the art.

The methods can further include the step of permanently or removably attaching the first wireline to the first pipe section and the second wireline to the second pipe section. The wirelines can be attached to the pipe sections in a variety of ways, including, but not limited to, clamps, springs, zip ties, or other fasteners. The methods can further include the step of disconnecting the first pipe section from the second pipe section; substituting a third pipe section for the first pipe section; and connecting a third wireline of the third pipe section to the second wireline.

According to another embodiment, a method of quickly disconnecting a first wireline from a second wireline in a well system comprises: removing a source of power to a first electromagnet, wherein the first electromagnet is located within a male housing of a first wireline, wherein the first wireline is removably attached to a first pipe section of a tubing string, wherein the step of removing causes an existing magnetic field between the first electromagnet of the first wireline and a metal of a female housing to cease, wherein the female housing is part of a second wireline, and wherein the second wireline is removably attached to a second pipe section of the tubing string; and allowing or causing the first wireline to become physically disconnected from the second wireline.

In order to break the wireline connection, the energy source 60 (and/or 61) can be turned off. This causes the electromagnet in each connector to stop generating a magnetic field, which in turn causes the attraction between the connectors of the connection points to cease. Any force applied to the wireline would then cause physical separation of the connectors and also each wireline section. In this example, sea currents would cause the connectors to separate at the connection points. Thus, in an emergency, such as an approaching storm, the wireline could be quickly disconnected along the tubing string and at the tool connection.

Note that the energy source does not need to be completely turned off. The energy source may be powered down to a level that does not generate a threshold magnetic field level that is needed to maintain a connection at connection points 34. This would allow the connection to be broken without having to completely power down the tool 23 or the device 60.

To re-establish the wireline connection, the energy source 60 (and/or 61) is powered up. This causes the electromagnets in the connectors at each connection point to form magnetic fields. This causes attraction to form between the connectors in each connection point, and which causes the wireline connection points to reconnect. As each section is reconnected, the electromagnet at the next connection point (either upstream or downstream from the previous connection point depending on the location of the energy source) is powered up, and causes the connection of the next wireline section. The process continues in this manner until the connection with the tool is re-established and the wireline is fully connected.

The coupler 70, 71 allows for easy addition to the tubing string. As additional pipe is needed, e.g. to drill deeper, additional pipe and wireline sections may be added as needed and then reconnected as described above.

The coupler 70, 71 allows for easy replacement of a section of wireline or tubing string pipe. The tubing string and associated wireline can be pulled and removed from the string until the faulty wireline or pipe is located. The pipe and/or wireline section may be replaced and then reconnected as described above.

Therefore, the present invention is well adapted to attain the ends and advantages mentioned as well as those that are inherent therein. The particular embodiments disclosed above are illustrative only, as the present invention may be modified and practiced in different but equivalent manners apparent to those skilled in the art having the benefit of the teachings herein. Furthermore, no limitations are intended to the details of construction or design herein shown, other than as described in the claims below. It is, therefore, evident that the particular illustrative embodiments disclosed above may be altered or modified and all such variations are considered within the scope and spirit of the present invention. While compositions and methods are described in terms of "comprising," "containing," or "including" various components or steps, the compositions and methods also can "consist essentially of" or "consist of" the various components and steps. Whenever a numerical range with a lower limit and an upper limit is disclosed, any number and any included range falling within the range is specifically disclosed. In particular, every range of values (of the form, "from about a to about b," or, equivalently, "from approximately a to b") disclosed herein is to be understood to set forth every number and range encompassed within the broader range of values. Also, the terms in the claims have their plain, ordinary meaning unless otherwise explicitly and clearly defined by the patentee. Moreover, the indefinite articles "a" or "an", as used in the claims, are defined herein to mean one or more than one of the element that it introduces. If there is any conflict in the usages of a word or term in this specification and one or more patent(s) or other documents that may be incorporated herein by reference, the definitions that are consistent with this specification should be adopted.

What is claimed is:

1. A wireline coupler that connects a first data wireline to a second data wireline comprising:

a first housing that is attached to the first data wireline, wherein the first housing comprises an electromagnet, and the first data wireline is permanently or removably attached to a first pipe section of a tubing string;

a second housing that is attached to the second data wireline, wherein the second housing comprises a metal, and the second data wireline is permanently or removably attached to a second pipe section of the tubing string;

wherein the electromagnet forms a magnetic field when electrical data flows in the first wireline, and wherein the magnetic field attracts the metal of the second housing and causes the first housing to physically connect with the second housing, such that the first data wireline is operationally connected with the second data wireline.

2. The wireline coupler of claim 1, wherein the first and second data wirelines are operative to perform one of: controlling a tool, relaying information about the tool, relaying information about an environment adjacent to the tool, relaying sensor information, relaying information or other data from various user applications, or combinations thereof.

3. The wireline coupler of claim 2, wherein the tool is one of a drill bit, a perforating gun, a core sampler, a sampling system, a slickline sampling system, a sensor, a packer, or combinations thereof.

4. The wireline coupler of claim 2, wherein the information is one of telemetry, revolutions per minute, temperature, orientation, depth, angle, flow rate, pressure, the concentration of particulate, other information, or combinations thereof.

5. The wireline coupler of claim 1, wherein the electromagnet comprises a metal and wherein the metal is selected from the group consisting of iron, nickel, cobalt, rare earth elements, and combinations thereof.

6. The wireline coupler of claim 1, wherein the metal is selected from the group consisting of iron, nickel, and combinations thereof.

7. The wireline coupler of claim 1, wherein the first wireline carries a data signal, wherein the data signal comprises a carrier wave and data, a radio frequency signal, power, or combinations thereof.

8. The wireline coupler of claim 1, further comprising: at least one fitting that is located on the first housing or the second housing; and a receiver that is located on the other of the second housing or the first housing, which is adapted to receive the fitting; wherein the fitting and the receiver act to align the first data wireline and the second data wireline.

9. A well system comprising:

a first pipe section having a first wireline that is associated with the first pipe section, wherein the first wireline has a male housing located at one end of the first wireline and a female housing located at the other end of the first wireline, wherein the male housing comprises a first electromagnet and the female housing comprises a first metal; and a second pipe section having a second wireline that is associated with the second pipe section, wherein the second wireline has a male housing located at one end of the second wireline and a female housing located at the other end of the second wireline, wherein the male housing comprises a second electromagnet and the female housing comprises a second metal;

wherein the male housing of the first wireline is placed proximate to the female housing of the second wireline, whereby when the first wireline is energized, the male housing of the first wireline is attracted to the female housing of the second wireline to physically couple the male housing of the first wireline to the female housing of the second wireline, and the first wireline is operationally connected to the second wireline, and whereby when the first wireline is de-energized, the male housing of the first wireline loses attraction to the female housing of the second wireline, and the first wireline is operationally disconnected to the second wireline.

10. The well system of claim 9, further comprising a controller that is operatively connected to the first wireline.

11. The well system of claim 9, further comprising a tool or sensor that is connected to the male housing of the second wireline.

12. The well system of claim 9, wherein at least the first and second wirelines are located inside of the first and second pipe sections.

13. The well system of claim 9, wherein at least the first and second wirelines are located outside of the first and second pipe sections.

14. The well system of claim 9, wherein at least the first and second wirelines are a data wireline.

15. The well system of claim 9, further comprising:

a third pipe section having a third wireline that is associated with the third pipe section, wherein the third wireline has a male housing located at one end of the third wireline and a female housing located at the other end of the third wireline, wherein the male housing comprises a third electromagnet and the female housing comprises a third metal;

wherein the male housing of the second wireline is placed proximate to the female housing of the third wireline, whereby when the second wireline is energized, the male housing of the second wireline is attracted to the female housing of the third wireline to physically couple the male housing of the second wireline to the female housing of the third wireline, and the second wireline is operationally connected to the third wireline, and whereby when the second wireline is de-energized, the male housing of the second wireline loses attraction to the female housing of the third wireline, and the second wireline is operationally disconnected from the third wireline.

16. A method of connecting a first pipe section to a second pipe section of a tubing string in a well system comprising:

providing a source of power to a first electromagnet, wherein the first electromagnet is part of a male housing of a first wireline, wherein the first wireline is associated with the first pipe section;

positioning the first wireline adjacent to a second wireline, wherein the second wireline is associated with the second pipe section, wherein the second wireline comprises a female housing, and wherein the female housing comprises a metal;

connecting the first pipe section to the second pipe section such that the male housing of the first wireline is located proximate to the female housing of the second wireline, wherein the step of providing the source of power forms a magnetic field such that the male housing attracts the female housing to the male housing; and allowing the first wireline and the second wireline to create a physical and electrical connection with one another in response to the magnetic field.

17. A method of quickly disconnecting a first wireline from a second wireline in a well system comprising:

removing a source of power to a first electromagnet, wherein the first electromagnet is part of a male housing of the first wireline, wherein the first wireline is permanently or removably attached to a first pipe section of a tubing string, wherein the step of removing causes an existing magnetic field between the first electromagnet of the first wireline and a metal of a female housing to cease, wherein the female housing is part of the second wireline, and wherein the second wireline is permanently or removably attached to a second pipe section of the tubing string; and allowing or causing the first wireline to become physically disconnected from the second wireline as a result of removing the source of power to the first electromagnet to cease the existing magnetic field between the first electromagnet of the first wireline and the metal of the female housing.

18. The method of claim 17, further comprising:

disconnecting the first pipe section from the second pipe section;

substituting a third pipe section for the first pipe section; and connecting a third wireline of the third pipe section to the second wireline.

* * * * *